US005875790A

United States Patent [19]

Morrison

[11] Patent Number: 5,875,790

[45] Date of Patent: Mar. 2, 1999

[54] COMB CUTTING GUIDE

[76] Inventor: Catherine M. Morrison, 397 Black Rock Rd., Rocky Mount, Va. 24151

[21] Appl. No.: 932,657

[22] Filed: Sep. 18, 1997

[51] Int. Cl.[6] ..... A45D 24/36

[52] U.S. Cl. ..... 132/213.1; 33/484; 33/512; 132/133; 132/131

[58] Field of Search ..... 132/213.1, 214, 132/213, 129, 132, 135, 145, 148, 155, 131, 133; 33/485, 460, 459, 461, 462, 484, 512

[56] References Cited

U.S. PATENT DOCUMENTS

| | | | |
|---|---|---|---|
| 46,082 | 1/1865 | Colburn | 132/148 |
| 55,349 | 6/1866 | Noyes . | |
| 84,860 | 12/1868 | Craig . | |
| 201,599 | 3/1878 | Drew | 132/148 |
| 395,444 | 1/1889 | Klein . | |
| 597,464 | 1/1898 | Girton | 33/460 |
| 600,650 | 3/1898 | Powell | 33/485 |
| 1,052,695 | 2/1913 | Sheldon | 132/148 |
| 1,596,737 | 8/1926 | Johnson . | |
| 1,662,373 | 3/1928 | Widdows . | |
| 1,726,390 | 8/1929 | Erhard et al. . | |
| 1,853,828 | 4/1932 | Mani . | |
| 2,659,122 | 11/1953 | Golubics . | |
| 2,677,179 | 5/1954 | Servilla . | |
| 2,686,973 | 8/1954 | Christianson et al. | 33/461 |
| 3,877,472 | 4/1975 | D'Angelo | 132/145 |
| 4,368,745 | 1/1983 | McGuffey | 132/213.1 |
| 4,517,998 | 5/1985 | Furco . | |
| 5,107,869 | 4/1992 | Henry | 132/213.1 |
| 5,259,114 | 11/1993 | Shorter | 132/148 |
| 5,402,805 | 4/1995 | Barinas . | |

FOREIGN PATENT DOCUMENTS

| | | | |
|---|---|---|---|
| 20460 | 9/1897 | United Kingdom | 132/133 |

*Primary Examiner*—Todd E. Manahan
*Assistant Examiner*—Eduardo C. Robert
*Attorney, Agent, or Firm*—Clyde I. Coughenour

[57] ABSTRACT

A first comb has a graduated scale attached near a first end of the scale so that the scale can be pivoted outwardly and inwardly from the first comb. A cutting guide first end is pivotably attached to the second end of the graduated scale. The graduated scale can be slidable lengthwise with respect to the first comb to position the cutting guide a select distance from the first comb. A swivel or hinge permits the graduated scale to extend in the plane of the first comb or to extend perpendicular to it or any angle in between. Clamping or friction provision permit the first comb and the graduated scale and the cutting guide to all be fixed in the plane of the first comb, either in a folded carrying configuration or in a ready-to-use configuration, or to fix the graduated scale perpendicular to the plane of the first comb and to fix the cutting guide parallel to the plane of the first comb at a fixed or at a select distance parallel to the plane of the first comb. A second comb first end is pivoted to a first end of the first comb, in essentially the same plane as the first comb, with the teeth of the two combs facing each other. Locking arrangements are provided on the second ends of the first and second combs to clamp and hold hair between the combs while cutting the hair using either one of the combs or the cutting guide to support or guide a hair cutting device.

20 Claims, 2 Drawing Sheets

COMB CUTTING GUIDE

BACKGROUND OF THE INVENTION

1. Field of the Invention

The invention is directed to the art of cutting hair. A comb has a scale and cutting guide pivotally attached to it for gauging the length of the hair to be cut or to be retained.

2. Description of Related Art

The use of combs and cutting guides in combination, with and separate from cutting means, is common in the art. Combs that pivot relative to one another in essentially the same plane are common with J. P. Noyes, U.S. Pat. No. 55,349, issued 5 Jun. 1866 and J. F. Golubics, U.S. Pat. No. 2,659,122, issued 17 Nov. 1953, examples of combs that pivot together with the teeth lying adjacent each other, but being essentially coplanar. H. W. Johnson, U.S. Pat. No. 1,596,737, issued 17 Aug. 1926, and C. Mani, U.S. Pat. No. 1,853,828, issued 12 Apr. 1932, are examples of comb means that pivot together with the teeth intermeshing in the same plane. J. W. Erhard et al, U.S. Pat. No. 1,726,390, issued 27 Aug. 1929 teach a comb pivotally attached to scissors. A. M. Widdows, U.S. Pat. No. 1,662,373, issued 13 Mar. 1928, teaches two combs used together for cutting with a slotted pivoted strip used with a hair-clamping means. M. Klein, U.S. Pat. No. 395,444, issued 1 Jan. 1889, teaches spaced parallel comb means with adjustable spacing means between the combs for positioning scissors a select distance between the comb means. M. S. Barinas, U.S. Pat. No. 5,402,805, issued 4 Apr. 1995, is an example of two pivoted comb-like means in essentially the same plane with a pin-slot securing means for holding the two together. S. J. Furco, U.S. Pat. No. 4,517,998, issued 21 May 1985, teaches the use of scale graduations on a comb for geometric hair styling. L. D. Craig, U.S. Pat. No. 84,860, issue 15 Dec. 1868, teaches shears that have a slotted plate adjustably clamped perpendicular to the plane of the shears with a comb formed perpendicular to one end of the slotted plate so that the distance between the parallel planes of the comb and shears can be adjusted for gauging hair cutting.

SUMMARY OF THE INVENTION

The basic invention is the combining of a comb with a scale that can be pivoted outwardly from the comb, for measuring the length of hair to be cut or retained, and back into the plane of the comb for storage and/or transport. The invention can include, in an essentially coplanar configuration, a pair of combs coextensive or offset by about one quarter of their width and pivotally attaching together at one end for clamping hair between them. The second ends of the combs are provided with a securing means for temporarily locking the combs together rigidly for holding hair in place between the combs. One of the combs can have a recess along its back edge or side for receiving the scale and the cutting guide. A graduated scale is pivotally attached to the end of the comb and/or in the recess so that it can be turned or pivoted to extend outwardly from the comb. When the scale is turned out from the comb, it can be positioned perpendicular to the plan of the comb or can be slid lengthwise on a pivot means attached to the comb. By rounding off the first end of the graduated scale and having the end of the recess flat and parallel or perpendicular to the plane of the comb and properly positioning the pivot means, the graduated scale can be slid lengthwise parallel or perpendicular to the plane of the comb. By having the smaller graduations on the scale second end, the graduations at the pivot point or comb edge or back directly indicate the distance between the comb and a cutting guide attached to the other end of the graduated scale. Positioning or locating means are provided on the second end of the graduated scale and on the pivoted first end of the cutting guide, for locating the graduated scale and cutting guide either perpendicular to each other or parallel to each other where they can be held or clamped together. As an alternative, the smaller graduations can be on the first end of the scale and the cutting guide can be slid along the graduated scale rather than having the graduated scale slid on one of the combs. Also, rather than having the scale secured to the comb so that it pivots outwardly in either the plane parallel to the plane of the comb or perpendicular to the plane of the comb, the graduated scale can be provided with a hinge means or held onto one of the combs by a swivel or hinge means so that the scale can be extended outwardly in a plane that is parallel or perpendicular to the plane of the comb or any angle in between.

By locking the hair between the combs and sliding a hair cutting means along the cutting guide, a straight cut of the hair at the length indicated by the scale or set between the cutting guide and combs on the graduated scale can be made. The comb and scale can be used without a guide or the combs can be used with the cutting means pressed and slid along the combs, using the combs as a cutting guide.

DESCRIPTION OF THE PREFERRED EMBODIMENTS

Figure 1:
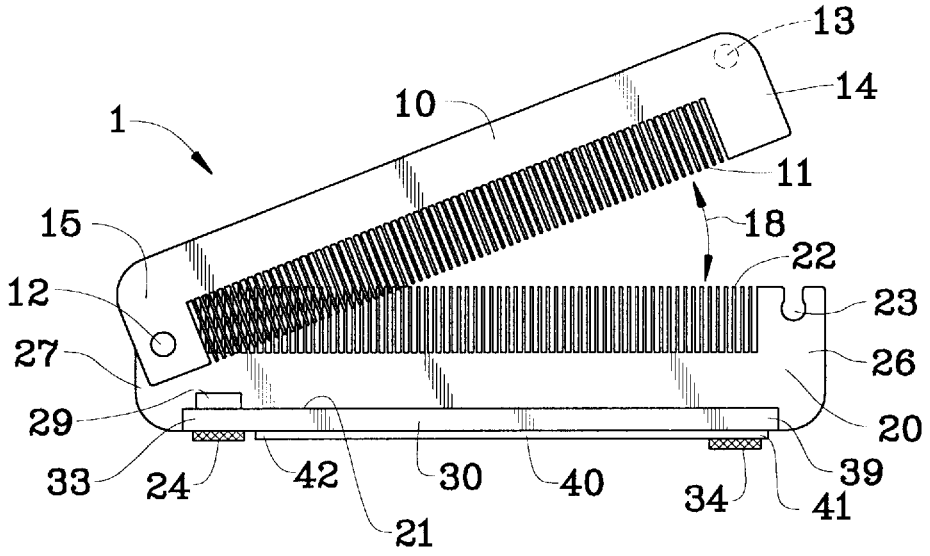
FIG. 1 is a top plan schematic view showing the combs, scale, and cutting guide all secured in the same plane.

Shown in FIG. 1 is a top view of the comb cutting guide 1 showing a second comb 10 having teeth 11 with a securing post 13 on its bottom second end 14 and a first and second comb pivot pin 12 on its first end 15. A first comb 20 is shown pivotally attached at its first end 27 to the second comb 10 by the first and second comb pivot pin 12. The first comb 20 has teeth 22 and a securing slot 23 on its second end 26. The second comb 10 and first comb 20 pivot toward each other and away from each other about pivot pin 12 along a pivot path 18. By opening the gap between the first and second combs, hair can be inserted between the combs after which the combs can be pivoted to close the gap and clamp the hair between the combs. The first and second combs are secured or temporarily locked together by having the second comb securing post 13 enter into the first comb securing slot 23. The securing slot 23 is slightly smaller than the securing post 13 so that a clamping action results to resiliently hold or lock the first and second combs together. The back edge of the first comb 20 is provided with an attachment recess 21 to accommodate a scale 30 and a cutting guide 40. The scale 30 first end 33 is secured to the first comb 20 first end 27 and is adjustably clamped to the first comb by a first comb clamp knob 24. While the clamping of the scale may be directly into the comb back, it is shown being clamped to a swivel or hinge means 29 that is frictionally pivoted while held in the comb back. The swivel or hinge means is free to rotate about its axis or securing pin that allows the scale to be rotated into planes that are angled with respect to the plane of the combs, including perpendicular to the plane of the combs and parallel to the plane of the combs. A cutting guide 40 first end 41 is pivotably attached to the scale second end 39. The cutting guide 40 is pivoted to and can be clamped onto the scale second end 39 by a scale clamp knob 34. The scale 30 and cutting guide 40 are shown in their folded or closed transport/storage configuration in FIG. 1. Although a recess is not necessary, a recess for the scale and cutting guide can be provided for along the top or along the bottom surface of the comb back rather than along the back edge of the comb. A recess is preferred as it reduces the amount of protrusion and number of exposed corners for easier and safer transport.

Figure 2:
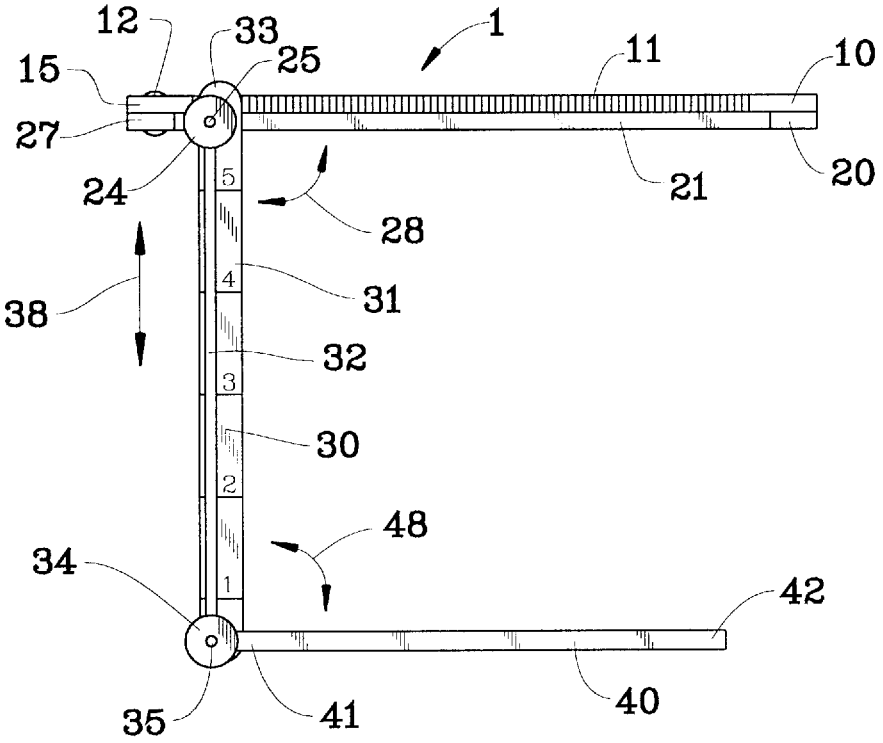
FIG. 2 is a side elevation schematic view showing the scale secured perpendicular to the plane of the combs and the cutting guide secured perpendicular to the scale and parallel with the combs.

FIG. 2 is a side view of the comb cutting guide 1 with the scale 30 and cutting guide 40 in an extended or in-use configuration. The first comb 20 clamp knob 24 has a threaded scale pin 25 that is fixed to the clamp knob and is screwed into female threads that can be provided in the first comb first end 27 or is fixed to the comb first end and threaded into female threads in the clamp knob, but it is shown secured into a swivel or hinge means 29. By loosening the first comb clamp knob 24, the scale 30 second end 39 can be pivoted 28 away from the first comb second end 26. With the scale extended, the scale can be slid lengthwise 38 to position the distance between the first comb 20 and the cutting guide 40. An adjustment slot 32 in combination with the scale graduations 31 permit any desired easily readable spacing to be set between the plane of the comb and the second end of the scale and cutting guide. After the desired placement of the scale, the first comb clamp knob 24 is turned to clamp the scale 30 in place. By loosening the scale clamp knob 34, the cutting guide 40 second end 42 is pivoted 48 away from the scale 30. Like the first comb clamp knob 24, the scale clamp knob 34 is provided with a threaded cutting guide pin 35. The cutting guide pin 35 is threaded into a female threaded hole in the scale second end 39 or into a threaded hole in the scale clamp knob 34. If the scale pin 25 of the comb knob is secured directly into the edge of the comb back, with or without a recess 21, the scale can only pivot in a plane perpendicular to the plane of the comb 20. If the comb clamp knob is secured directly into the comb back top or bottom surface, with or without a recess in the comb back, the scale can only pivot in a plane parallel to the plane of the comb 20. By use of a swivel or hinge means 29, with or without a recess, the scale can be pivoted in planes that are other than parallel to or perpendicular to the plane of the comb 20.

Figure 3:
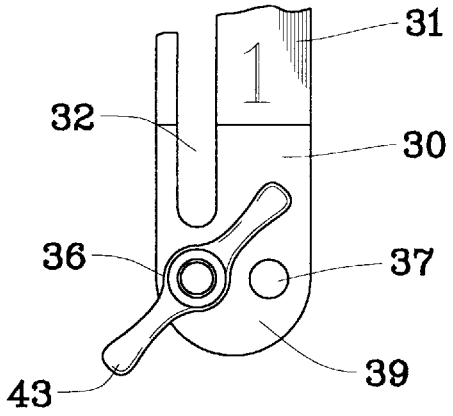
FIG. 3 is an enlarged isolated detail view of the lower front portion of the scale of FIG. 2 with an alternate clamping means.
Figure 4:
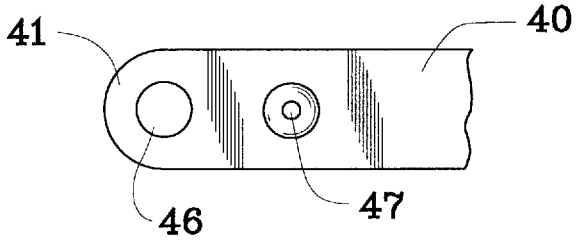
FIG. 4 is an enlarged isolated detail view of the left back portion of the cutting guide of FIG. 2.

The primary or preferred positions of the cutting guide are perpendicular to the scale, for placing the cutting guide parallel to the plane of the combs for cutting, or in the plane of the combs and overlapping the scale, for folding the comb cutting guide into the closed transport/storage configuration. To accurately secure these two positions, the scale second end 39 and the cutting guide first end 41 are provided with location means. As shown in FIG. 3, the adjustment slot 32 extends into close proximity to the threaded cutting guide post 36, and a securing recess 37 is provided adjacent to the post. The cutting guide post 36 is shown with a wing nut 43 as an alternative to the threaded hole or clamp knob clamping means of FIGS. 1 and 2. The cutting guide post 36 center is in line with the centerline of the adjustment slot 32, and the center of the securing recess 37 is perpendicular to the centerline of the adjustment slot 32 at the center of the cutting guide post 36. FIG. 4 shows a portion of the back side of the cutting guide shown in FIG. 2. The cutting guide 40 first end 41 is provided with a cutting guide post or pin hole 46 and a cutting guide securing protrusion 47. Both the cutting guide post or pin hole 46 and securing protrusion 47 are essentially centered along the centerline for the cutting guide 40 or are parallel to it. With the cutting guide post 36 or pin 35 in place and the clamp knob 34 or wing nut 43 loosened, the cutting guide 40 can be pivoted 48 to overlie the scale 30 or to be perpendicular to it. By placement of the cutting guide securing protrusion 47 within the slot 32, or other recess located at this position, a first locator position is provided and by tightening the scale clamp knob 34 or wing nut 43, the cutting guide 40 is clamped against the scale for transport/storage. By placement of the cutting guide securing protrusion 47 within the securing recess 37 a second locator position is provided and by tightening the scale clamp knob 34 or wing nut 43, the cutting guide 40 is clamped in a position that is perpendicular to the scale and thus parallel to or in the plane of the combs.

The angle the scale and cutting guide is locked into is optional with the user of the guide. The user can use the comb or the cutting guide as a support for the cutting means when cutting a straight edge on hair held between the combs teeth. The combs need not be adjacent each other, they could have their teeth intertwined. Any of the known securing means could be used to hold the combs locked together. The way in which the scale and cutting guide are clamped together is optional. The configuration of the scale is optional so long as the pivotal or adjustment function is maintained. The most preferred use of the cutting guide is to have the cutting guide in the plane of the comb or in a plane parallel to the plane of the combs and to have the cutting means slide along the cutting guide.

The comb cutting guide is used by loosening the first comb clamping knob 24, pivoting 28 the scale in the plane of the comb or perpendicular to the plane of the combs, and sliding 38 the scale 30 to space the distance between the combs and cutting guide to the length the hair is desired to be left at or cut to. The clamping knob 24 is then tightened. The clamping knob 34 is then loosened and the cutting guide 40 pivoted 48 to be parallel to the combs or comb back , or other desired angle, after which the clamping knob 34 or wing nut 43 is tightened. The cutting means is then slid or guided down the cutting guide while cutting the hair. After cutting is completed, the scale and cutting guide can be pivoted back into the plane of the combs and clamped into that position for transport and/or storage.

Figure 5:
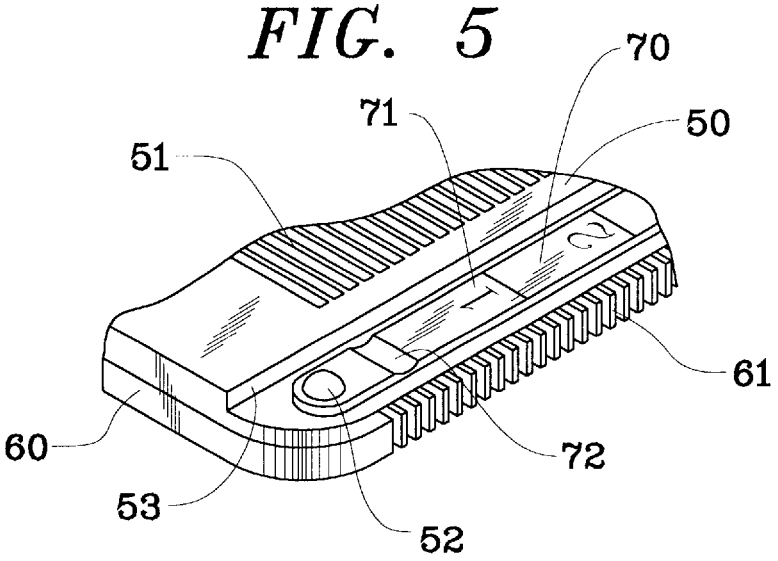
FIG. 5 is a fragmentary view of a modification of the invention.

FIG. 5 is a modification of the invention showing two combs 50,60 and a scale 70 secured together by a single securing pivot 52. The recess 53 is shown on the top back side of a first comb 50. The first comb 50, with teeth 51, and second comb 60, with teeth 61, are essentially coextensive and in the same plane in the folded or transport position shown. As a scale 70, a rigid material can be used with a hinge used to move the scale portion into an angular or perpendicular position with respect to the plane of the comb. The hinge can be associated with the securing pivot 52 or separate from it. The scale 70 shown is intended to be of a semi-rigid plastic that has a recess 72 pressed into it to form a living hinge for bending the scale into an angular or perpendicular position with respect to the plane of the combs. The scale 70 is provided with graduations or numbers 71 for measuring distance from the first comb. The scale can be pivoted outwardly about the securing pivot 52 and can be bent into a perpendicular or other angular position with respect to the plane of the combs 50,60. The measurements can be taken from the plane of the combs by having the scale numbers start from the pivoted end of the scale at the recess or hinge 72. The combs can be provided with a locking means 13, 23, similar to those shown in FIG. 1, and a guide 40, similar to that shown in FIG. 1, can be provided. The locating slot 32 can be replaced with an indentation, such as 37 shown in FIG. 3. In place of clamping means 24, 34, shown in FIGS. 1 and 2, a simple friction fit is provided by irregularities, at the pivot securing, and/or a tight connection is provided between the pivoted parts of the device to create a frictional fit between the parts.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

I claim:

1. A comb cutting guide including:

a first comb being essentially flat and elongated and having a first end and a second end and a back with a multiplicity of teeth extending outwardly from said back, all essentially in one plane, a scale having a first end and a second end;

a first comb pivot means on said first comb back;

said scale being pivotably attached to said first comb back in the vicinity of said scale first end;

said scale second end being extendable outwardly and inwardly from said flat elongated first comb about said first comb back pivot means;

means for permitting said scale to be extended outwardly and inwardly at an angle to said plane of said first comb.

2. The comb cutting guide of claim 1 wherein:

said first comb back has a slot that is deep enough to accommodate said scale in essentially said plane of said first comb for storage and transport.

3. The comb cutting guide of claim 1 wherein:

said scale is frictionally secured to said first comb by said first comb back pivot means, so that said angle said scale extends outwardly with respect to said first comb back can be adjusted and temporarily secured in said adjusted position;

a hinge means is provided near said scale first end so that said angle said scale forms with respect to said plane of said first comb can be adjusted.

4. The comb cutting guide of claim 1 wherein:

said means for permitting said scale to be extended outwardly and inwardly at an angle to said plane of said first comb is a hinge.

5. The comb cutting guide of claim 4 wherein:

said hinge is a scale hinge means located near said scale first end for rotating said scale second end out of said plane of said first comb.

6. The comb cutting guide of claim 1 wherein:

said scale has graduations and is slidable relative to said first comb so that the distance between said scale second end and said first comb can be selectively adjusted.

7. The comb cutting guide of claim 6 wherein:

said scale graduations begin with the lowest reading on said scale second end so that alignment of a graduation with said first comb will directly indicate the distance between said first comb and said scale second end.

8. The comb cutting guide of claim 6 wherein:

said scale has a slot, with a center line, that extends a major portion of the length of said scale between said scale first end and said scale second end;

said first comb pivot means includes a scale pin that is slidable within said scale slot for adjusting the distance between said scale second end and said first comb.

9. The comb cutting guide of claim 1 wherein:

a cutting guide has a first end and a second end and a center line;

said scale second end has a pivot means;

said cutting guide first end has an attachment means that is pivotably attached to said scale second end pivot means.

10. The comb cutting guide of claim 9 wherein:

said first comb pivot means includes a clamping means for securing said scale in a selected position relative to said first comb;

said scale second end pivot means includes a clamping means for securing said cutting guide in a selected position relative to said scale.

11. The comb cutting guide of claim 9 wherein:

said scale has location means and said cutting guide has location means so that said cutting guide center line can be pivoted to be located parallel to said scale and can be pivoted to be located perpendicular to said scale.

12. The comb cutting guide of claim 11 wherein:

said cutting guide location means is parallel to said cutting guide center line and is in line with said cutting guide attachment means and is adjacent to said cutting guide attachment means;

said scale has a center line that extends the length of said scale between said scale first end and said scale second end;

said scale location means consists of a first locator and a second locator, said scale first locator is perpendicular to said scale center line on a line through said scale second end pivot means and is adjacent to said scale second end pivot means;

said scale second locator is adjacent to said scale second end pivot means and is parallel with said scale center line, so that said cutting guide location means can be alined with said scale first locator, to locate said cutting guide perpendicular to said scale center line, and can be alined with said scale second locator, to locate said cutting guide parallel with said scale center line.

13. A comb cutting guide including:

a first comb being essentially flat and elongated and having a first end and a second end and a back with a multiplicity of teeth extending outwardly from said back, all essentially in one plane;

a scale having a first end and a second end;

a first comb pivot means on said first comb back;

said scale being pivotably attached to said first comb back in the vicinity of said comb first end;

said scale second end being extendable outwardly and inwardly from said flat elongated first comb about said first comb back pivot means;

a second comb, said second comb being essentially flat and elongated and having a first end and a second end and a back with a multiplicity of teeth extending outwardly from said back, all essentially in one plane;

said first comb and said second comb are provided with a pivot means that pivotably attaches said first comb and said second comb to each other at said first comb first end and at said second comb first end with said first comb teeth and said second comb teeth facing inwardly toward each other so that hair can be held between said first comb teeth and said second comb teeth.

14. The comb cutting guide of claim 13 wherein:

means are provided for permitting said scale to be extended outwardly and inwardly at an angle to said plane of said first comb.

15. The comb cutting guide of claim 13 wherein:

said pivot means on said first comb back is frictionally secured to said scale first end and is the same pivot means that pivotally attaches said first comb to said second comb, said scale first end is provided with a hinge means that permits said scale to be move outwardly from and inwardly into said plane of said first and said second combs.

16. The comb cutting guide of claim 13 wherein said scale has a slot with a center line that extends a major portion of the length of said scale between said scale first end and said scale second end;

said first comb pivot means includes a scale pin that is slidable in said scale slot for adjusting the distance between said scale second end and said plane of said first comb;

a cutting guide has a first end and a second end;

said scale second end has a pivot means;

said cutting guide first end has an attachment means that is pivotably attached to said scale second end pivot means.

17. The comb cutting guide of claim 13 including:

means for permitting said scale to be extended outwardly and inwardly at various angles to the plane of said first comb, said first comb pivot means on said first comb back is on said first comb first end;

said first comb pivot means includes a clamping means for securing said scale in a selected relationship with said first comb.

18. The comb cutting guide of claim 13 wherein:

said first comb second end and said second comb second end are provided with locking means for locking said first comb and said second comb together for clamping hair between said first comb and said second comb during cutting.

19. The comb cutting guide of claim 18 wherein:

a cutting guide has a first end and a second end and a center line;

said scale second end has a pivot means;

said cutting guide first end has an attachment means that is pivotably attached to said scale second end pivot means.

20. The comb cutting guide of claim 19 wherein said first comb back has a slot that is deep enough to accommodate said scale and said cutting guide in essentially said plane of said first comb for storage and transport.

* * * * *